United States Patent [19]

Galabov et al.

[11] Patent Number: 4,475,315

[45] Date of Patent: Oct. 9, 1984

[54] INDUCTOR FOR MAGNETIC ABRASIVE POLISHING

[75] Inventors: Peter K. Galabov; Boris G. Makedonski, Stefan J. Kochev; Maya T. Angelova, all of Sofia, Bulgaria

[73] Assignee: Centralen Mashinostroitelen Institute, Sofia, Bulgaria

[21] Appl. No.: 465,766

[22] Filed: Feb. 11, 1983

[30] Foreign Application Priority Data

Feb. 11, 1982 [BG] Bulgaria ..... 55331

[51] Int. Cl.³ ..... B24B 5/18

[52] U.S. Cl. ..... 51/72 R; 51/103 R; 51/292

[58] Field of Search ..... 51/72 R, 74 R, 80 R, 51/80 A, 82 R, 83 R, 88, 89, 103 R, 103 WH, 103 TF, 263, 292, 317, 318, 430; 125/13 R, 15

[56] References Cited

U.S. PATENT DOCUMENTS

| | | | |
|---|---|---|---|
| 3,898,769 | 8/1975 | Makedonski et al. | 51/292 X |
| 4,040,209 | 8/1977 | Shikhirev et al. | 51/80 A |
| 4,187,081 | 2/1980 | Shikhirev et al. | 51/80 A X |
| 4,204,370 | 5/1980 | Shikhirev et al. | 51/80 A |
| 4,306,386 | 12/1981 | Sakulevich et al. | 51/317 |

FOREIGN PATENT DOCUMENTS

| | | | |
|---|---|---|---|
| 23845 | of 1899 | United Kingdom | 51/292 |
| 779042 | 11/1980 | U.S.S.R. | 51/88 |

*Primary Examiner*—Robert P. Olszewski

[57] ABSTRACT

Inductor for magnetic abrasive polishing. The inductor has at least one electromagnetic coil which is surrounded by a circular cylindrical sleeve-like shell mounted coaxial of the coil. The coil is held from rotation, whereas the shell is driven to rotate thereabout. The shell is made up of three coaxial rings disposed in a line, the end rings being made of ferromagnetic material, whereas the central ring is a spacing ring made of non-magnetic material. The external cylindrical surface of the shell has machined grooves therein disposed at a pronounced angle with respect to the axis of the inductor. The grooves form sharp edges with the generally circular cylindrical outer surface of the shell. The magnetic abrasive particles disposed on the cylindrical outer surface of the shell, when coming into contact with the workpieces, smooth down the peaks of the micro-irregularities of the workpieces, and at given moments, when magnetic abrasive particles are piled up on the shell and there is a risk of jamming of the machine, the particles are taken up in one or more of the inclined grooves in the cylindrical surface of the inductor. The sharp outer edges of the grooves concentrate the abrasive ferromagnetic particles, and they thus intensify the machining or grinding process.

5 Claims, 2 Drawing Figures

INDUCTOR FOR MAGNETIC ABRASIVE POLISHING

This invention relates to an inductor for magnetic abrasive polishing, particularly to an inductor for the centerless machining of rotating workpieces.

BACKGROUND OF THE INVENTION

A known inductor for magnetic abrasive polishing, disclosed in Bulgarian Pat. No. 26,982, comprises one or several electromagnetic coils, limited by discs. In the end of the inductor there are provided flanges, while each of the coils is enveloped by three axially distributed rings, the two end rings being made of ferromagnetic material while the central ring is made of non-magnetic material. The central ring has zigzag-shaped side surfaces, corresponding to the side surfaces of both end rings. The discs and the coils are fastened rigidly to a rotating shaft made of ferromagnetic material.

A drawback of this known inductor lies in the fact that during its rotation, as a result of the unbalance produced by the windings of the rotating coils, there result vibrations which impair the quality of the machined surface, and the pulsating loading shortens the life of the bearings on which the inductor is supported. Another drawback lies in the jamming of the workpiece as a result of the piling up of ferromagnetic abrasive powder on the surface of the inductor.

OBJECTS AND SUMMARY OF THE INVENTION

The present invention has as its general object the provision of an inductor which produces a high quality of the machined surface and a reduction of its out of roundness or ovality.

This object is achieved by the inductor for magnetic abrasive polishing of the present invention. Such inductor comprises one or more electromagnetic coils, limited by discs, and in both ends of the inductor there are provided flanges having sleeve-like extensions thereon which are coaxial and which house bearings. Each of the coils is enveloped by three axially distributed rings, two of the rings being end rings made of ferromagnetic material, while the central ring is made of non-magnetic material. In accordance with the invention, the electromagnetic coils are fastened to a fixed axle, which is made in the form of a central body made of ferromagnetic material, onto which there are pressed into place tips of non-magnetic material, such tips being rigidly supported on supports and bearings disposed in the central, sleeve-like members attached to the flanges. The flanges are axially movable and are pressed against the rings enveloping the coils, and in the external cylindrical surface of the rings there are provided grooves which extend at an angle with respect to the longitudinal axis of the inductor.

The advantages of this inductor lie in the improved quality of the machined surfaces produced thereby, and the prolonged service life of the inductor bearings as a result of their lower loading. Moreover, there is also avoided the danger of jamming of workpiece during the magnetic abrasive polishing.

For a better understanding of the invention, reference should be had to the accompanying drawings, in which there is illustrated and described a preferred embodiment of the invention.

DETAILED DESCRIPTION OF THE PREFERRED EMBODIMENT

Figures 1, 2:
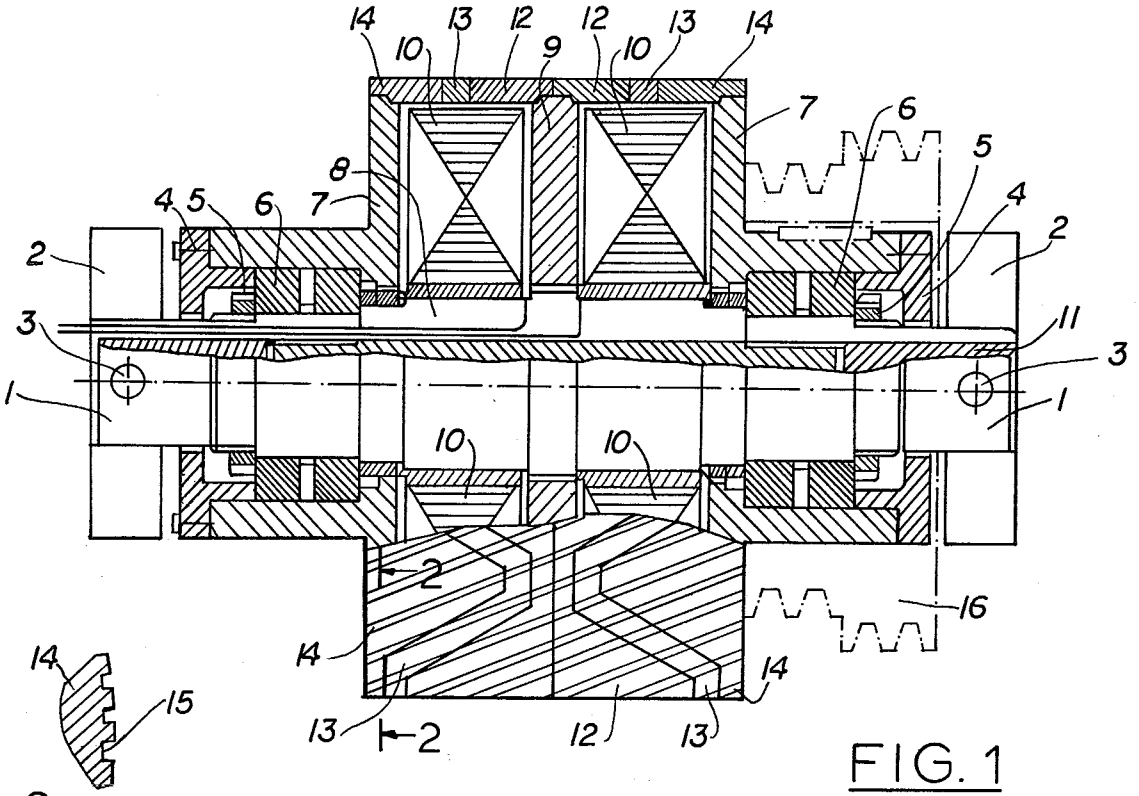
FIG. 1 is a general, partly sectional view of the inductor.
FIG. 2 is a fragmentary sectional view, the section being taken along line 2—2 in FIG. 1.

The inductor shown comprises a fixed axle with a central body 11 made of ferromagnetic material onto which there are pressed into place end tips 1 made of non-magnetic material. The axle is fastened by means of bolts 3 to respective supports 2 made of non-magnetic material. On the central body 11 there is fastened a central disc 9 made of ferromagnetic material, and on the two sides of disc 9 there are fixedly mounted wound coils 10. On both tips 1 there are fastened by means of nuts 5 bearings 6, the bearings being disposed in the central bores of the sleeve-like extensions which are made integral with end flanges 7 made of ferromagnetic material, the bearings being pressed actually inwardly by covers 4. A longitudinal extending groove 8 in the central body 11 provides for the passage of wires for feeding the coils 10. Around each coil there are disposed three rings. The end rings 12 and 14 are made of ferromagnetic material, while the central ring 13 is made of non-magnetic material. In the cylindrical surface of the inductor there are machined grooves 15 which are disposed at an angle to the longitudinal axis of the central body 11. When employing the inductor of the invention in a known arrangement for centerless machining, opposite to the inductor there is provided a screw-type feeder for feeding ferromagnetic abrasive material to the surface of the inductor. Such feeder is not shown in the drawings.

It will be understood from the above that the constructions of the two coils 10 and of the rings 12, 13, and 14 associated with each of the coils are the same in each case. When two coils are employed, as shown, the two central abutting rings 12, made of ferromagnetic material, are of the same polarity, and the two end rings 14, also made of ferromagnetic material, are of the opposite polarity. The magnetic circuit between the respective rings 12 and 14 is completed by the ferromagnetic particulate abrasive material which is disposed upon the outer surfaces of the rings 12, 13 and 14, such surfaces forming the outer surface of the inductor as a whole.

The above-described inductor operates as follows: By energizing the coils 10 there is produced a magnetic field associated with each of the coils, such fields retaining the supplied ferromagnetic particles upon the outer surface of the inductor. The right-hand flange 7 has connected thereto a V-grooved pulley 16, such pulley being driven by suitable prime mover through a V-belt (not shown) so that such flange 7 is rotated and carries with it in rotation the rings 14, 13 and 12, associated with the right-hand coil 10 and the rings 12, 13 and 14, associated with the left-hand coil 10, as well as the left-hand flange 7. The coils 10, the central disc 9, and the central body 11 remain immovable. The magnetic abrasive particles disposed on the cylindrical outer surface of the inductor, when coming into contact with the workpieces fed into the centerless grinding machine, smooth down the peaks of the micro-irregularities on the workpiece, and at given times, when magnetic abrasive particles are piled up and there is a risk of jamming of the upon the outer surface of the inductor, they are taken up in one or more of the inclined grooves 15 in the cylindrical outer surface of the inductor. The edges of the inclined grooves 15 constitute concentrators of the magnetic field, so that they intensify the grouping of the ferromagnetic particles thereabout and thus intensify the machining process.

Although the invention is illustrated and described with reference to one preferred embodiment thereof, it is to be expressly understood that it is in no way limited to the disclosure of such a preferred embodiment, but is capable of numerous modifications within the scope of the appended claims.

We claim:

1. An inductor for centerless grinding by ferromagnetic abrasive particles, comprising an electromagnetic coil, means for supporting the coil and holding it stationary, means for energizing the coil, and a circular cylindrical shell coaxial of and surrounding the electromagnetic coil, said shell being made up of two axially aligned end rings made of ferromagnetic material and a central ring made of non-magnetic material separating said two end rings, and means for rotatably driving the shell about the coil.

2. The inductor according to claim 1, wherein the shell is provided with end flanges, the end flanges having central sleeve-like members extending in opposite axial directions, and bearings disposed within the sleeve-like parts of the shell, the means for rotating the shell comprising driven means attached to one of said end flanges.

3. An inductor according to claim 1, wherein the outer surface of the shell is provided with grooves which extend at a marked angle with respect to the axis of rotation of the shell.

4. The inductor according to claim 3, wherein the grooves have radially inwardly extending walls which make a sharp angle with the outer cylindrical surface of the shell.

5. An inductor according to claim 1, comprising at least two similar electromagnetic coils and two similar shells which cooperate with the respective coils, the coils and the shells being disposed end to end and in coaxial relationship.

* * * * *